US010142748B2

(12) United States Patent
Karamuk et al.

(10) Patent No.: US 10,142,748 B2
(45) Date of Patent: Nov. 27, 2018

(54) THERMOFORMED ACOUSTIC SEAL

(71) Applicant: Sonova AG, Stäfa (CH)

(72) Inventors: Erdal Karamuk, Männedorf (CH); Markus Müller, Männedorf (CH)

(73) Assignee: Sonova AG, Staefa (CH)

( * ) Notice: Subject to any disclaimer, the term of this patent is extended or adjusted under 35 U.S.C. 154(b) by 75 days.

(21) Appl. No.: 15/122,223

(22) PCT Filed: Mar. 6, 2014

(86) PCT No.: PCT/EP2014/054315

§ 371 (c)(1),
(2) Date: Aug. 29, 2016

(87) PCT Pub. No.: WO2015/131945

PCT Pub. Date: Sep. 11, 2011

(65) Prior Publication Data

US 2016/0373868 A1 Dec. 22, 2016

(51) Int. Cl.
*H04R 25/00* (2006.01)
*D01D 5/00* (2006.01)

(52) U.S. Cl.
CPC ..... *H04R 25/652* (2013.01); *D01D 5/0084* (2013.01); *H04R 25/658* (2013.01); *H04R 2225/023* (2013.01); *H04R 2225/025* (2013.01)

(58) Field of Classification Search
CPC .... H04R 25/65; H04R 25/652; H04R 25/658; H04R 25/656
USPC ..... 181/129, 130, 135; 381/322, 328
See application file for complete search history.

(56) References Cited

U.S. PATENT DOCUMENTS 4,969,534 A * 11/1990 Kolpe ..... H04R 25/456 181/130
7,043,038 B2 * 5/2006 Bachler ..... H04R 25/658 381/322
7,113,611 B2 * 9/2006 Leedom ..... H04R 25/608 381/322
7,580,537 B2 * 8/2009 Urso ..... H04R 25/652 381/322
7,664,282 B2 * 2/2010 Urso ..... H04R 25/656 181/135
2002/0025055 A1 2/2002 Stonikas et al.
2004/0017922 A1 1/2004 Bachler et al.
2006/0291682 A1 12/2006 Urso et al.
2010/0100116 A1 * 4/2010 Brister ..... A61F 5/003 606/192
2011/0256791 A1 * 10/2011 Seidel ..... D04H 5/02 442/329
2011/0280425 A1 * 11/2011 Gibbons ..... H04R 1/1016 381/328
2013/0108097 A1 5/2013 Neilson
(Continued)

FOREIGN PATENT DOCUMENTS

WO WO 2010116006 A2 * 10/2010 ..... H04R 1/227

OTHER PUBLICATIONS

PCT Search Report dated Oct. 27, 2014 for PCT App. Ser. No. PCT/EP2014/054315.

*Primary Examiner* — Jeremy Luks
(74) *Attorney, Agent, or Firm* — Henricks Slavin LLP

(57) ABSTRACT

An at least partially acoustically sealing element for retaining an in-the-ear device within an ear canal is characterized in that the element comprises at least one textile layer and that it is manufactured by means of thermoforming.

18 Claims, 4 Drawing Sheets

(56) References Cited

U.S. PATENT DOCUMENTS

| | | | | |
|---|---|---|---|---|
| 2014/0272359 | A1* | 9/2014 | Cheng | A61F 13/4752 428/219 |
| 2014/0308867 | A1* | 10/2014 | Van Emmerick | C23C 14/20 442/189 |
| 2015/0063612 | A1* | 3/2015 | Petersen | H04R 25/453 381/313 |

* cited by examiner

THERMOFORMED ACOUSTIC SEAL

CROSS-REFERENCE TO RELATED APPLICATIONS

This application is the U.S. National Stage of PCT App. Ser. No. PCT/EP2014/054315, filed Mar. 6, 2014.

The present invention refers to an at least partially acoustically sealing element for retaining an in-the-ear hearing device or component thereof within an ear canal and to a method for producing the at least partially acoustically sealing element.

In particular the invention relates to acoustic sealing retainers for extended wear applications of hearing aids and hearing aid components. In such an application, the hearing aid is placed e.g. deep into the ear canal of a patient (~4 mm to the TM) and can remain there for a period of several weeks or even months without the need of taking out the device.

A schematic view of an extended wear hearing instrument (2) placed deep in the ear canal close to the tympanic membrane with the acoustic seals is shown in the attached FIG. 1.

Some generic requirements for extended wear sealing retainers are given in Table 1 below.

TABLE 1

Some generic requirements for extended wear sealing retainers.

| Property | Requirement |
|---|---|
| Mechanical compliance | Minimal pressure on canal walls upon compression or deformation |
| Pressure distribution | Local pressure on the ear canal wall smaller than ~12 mmHg (=venous capillary return pressure) |
| Water vapor transmission | High water vapor transmission rate in order to reduce moisture accumulation in the closed ear canal. |
| Retention/friction - No migration | Sufficient surface friction to the surrounding skin in order to avoid migration of the device |
| Mechanical relaxation/ acoustic sealing | Sufficient acoustic attenuation in order to prevent feedback (typical: >30 dB between 200 Hz and 6 kHz). |
| Durability/environmental resistance | No degradation or change of structural integrity in prolonged contact with sweat, ear wax and soapy water. |
| Venting/static pressure equalization | Allow static pressure equalization between surrounding and closed residual volume in ear canal. |
| Biocompatibility | Skin biocompatibility with regard to ISO 10993-1 (not cytotoxic, no irritant, no sensitization) |

Compression-designed sealing retainers for extended wear hearing devices are well known and various publications have been established regarding their design.

Within the U.S. Ser. No. 07/580,537 a generic description of seal design for extended wear applications for focus on minimal contact force and scallop design is given. Different materials are mentioned, including porous foams of silicones and other elastomers.

The U.S. Ser. No. 07/664,282 contains a generic description of seal design for extended wear applications with focus on minimal contact force and scallop design is given. Different materials are mentioned, including porous foams of silicones and other elastomeric polymers.

The U.S. Ser. No. 07/113,611 discloses a large variety of eartips for a non-custom CIC with different solutions for venting. The tip is flexible and molded of a continuous material.

Main limitation of the current designs is manufacturing reproducibility within the narrow specifications as mentioned in Table 1. Currently manufactured seals for extended wear applications are made of hydrophilic polyurethane foam that is net-shaped molded. FIG. 2 as attached shows a cross section of a typical seal for extended wear applications.

The surface to volume ratio is very much in disfavor of a net-shape reaction molding method, since such reactions are usually rather fast and thus difficult to control in a very limited volume. Parameters such as ration of A/B components of the PUR foam, temperature of components, shear rate of mixing, environmental temperature and humidity, amount of mixture poured into a mould, surface properties (roughness, wettability) and temperature of such a mould and the time from filling and closing a mould (shut-off time) all play a critical role for the quality of foam such as size and distribution of pores, skin thickness and material density. As for a hearing aid application usually several sizes of such seals are necessary these parameters have to be identified and controlled for each design. Furthermore the current manufacturing method has significant limitations when it comes to the minimal wall thickness or feature size that can be manufactured with the current reactive foaming approach. In order to fulfill the rather tight specifications given in Table 1 above, the manufacturing process of net-shape foaming is followed by various measurement steps (size, flexibility, acoustic attenuation) which limit the throughput at the manufacturing site and significantly increase cost.

Alternative manufacturing methods of net-shaping a porous polymer parts are well known for thermoplastic elastomers and silicone rubbers. Such parts can be made by physical foaming where a highly pressurized gas is injected into the molten or yet uncured polymer and thus by controlled expansion in a mold creates a porous structure (examples are the MuCell process by Trexel, http://www.trexel.com/, or the OptiFoam process by Sulzer, http://www.sulzerchemtech.com). However the basic problem still remains as these technologies also have limitations when it comes to the manufacturing of small parts with minimal wall thickness and an adverse surface to volume ratio.

To manufacture a compression-design acoustic seal for an extended wear application the process must allow for exact control of mechanical dimensions as well as size and distribution of pores within the part in order to have sufficient flexibility, acoustic attenuation and moisture vapor transport rate. In rough figures, this can be summarized as in the following table 2:

| | |
|---|---|
| Ideal mechanical design rules would be: | Local wall thickness of <0.3 mm must be possible<br>Geometric features (holes, steps) of <0.3 mm must be possible<br>Sudden wall thickness changes of <0.3 mm to >1.5 mm |
| Ideal porosity | Porosity >50%<br>Average pore size 100 □m<br>Minimum pore size 50 □m<br>Maximum pore size 150 □m |
| Surface roughness | It is hypothesized that a rough surface (μm-scale) is preferable for comfort and ear health. |

This is very difficult to achieve with an in-situ foaming process as pore distribution and size are determined by the different phases of the foaming. Defined surface roughness is difficult to achieve, since usually a compact flat skin is formed during curing in the mold. However a smooth surface is not always favorable, as it allows a film of liquid to form between the skin and the seal.

The object of the present invention is to propose an alternative to known foam seals to avoid the described disadvantage.

The further object is to propose a manufacturing process for producing seals in an accelerated and easier way as actually known.

According to the present invention an at least partially acoustically sealing element for retaining an in-the-ear hearing device within an ear canal is described according to the wording of claim 1. Proposed is that the element comprises at least one textile layer made out of a woven, non-woven or knitted fabric or fibrous-web respectively and that it is brought into a three-dimensional geometry by means of thermoforming. Industrial textile technology is widely used in biomedicine to produce components for medical products such as vascular grafts, hernia meshes and the like. Depending on both, the material and the texture, textiles offer a unique set of properties making textiles favorable to be used for seals in extended wear applications or as earpieces (domes) in open or closed fittings.

Textiles commonly used in biomedical application are made out of fibers such as polypropylene (PP) and polyethyleneterephthalate (PET; polyester), polyetheretherketone (PEEK) and polytetrafluorethylene (PTFE), polyglycolides and polylactides. The fibers get amalgamated into homogeneous fabrics using different fabrication techniques. Knitted structures are formed by interlocking loops of yarn tying knots in an either weft or warp pattern. Woven fabrics are created by interlacing yarns or wires in an over-under perpendicular pattern. Nonwoven structures can be formed by electro-spinning or by interlocking fibers and filaments using mechanical, thermal, or chemical means.

Depending on both, the choice of the fiber material and the manufacturing technique mechanical and physical properties like flexibility, density, conformability, compressibility, acoustic attenuation, porosity and permeability can be adjusted according to the specific requirement of the application.

The use of textiles for hearing aid applications is known in general. U.S. Pat. No. 7,043,038 B2 describes an InEar device comprising an active module and an outer textile layer which snugly adapts to the individual geometry of the ear canal to compensate for ear canal movements during speaking and chewing. The textile layer can consist of single sub-layers with different properties. However the document does not explain how a three-dimensionally shape could be generated from a generally two-dimensional textile structure.

This is the content of the current invention.

While there are well established methods to manufacture tubular textile structures (e.g. circular weaving) it is more difficult to bring textile into a three-dimensional shape with fine geometrical details in the sub-millimeter range. The approach presented here is to use the process of thermoforming for the manufacturing of detailed three-dimensional structures and the resulting structures as seals or earpieces for hearing instruments.

Thus, the invention claims an at least partially acoustically sealing element for retaining an in-the-ear device within an ear canal, characterized in that the element comprises at least one textile layer and is manufactured by means of thermoforming.

According to one embodiment, it is proposed that the porosity of the layer is designed to allow high moisture and gas permeability.

According to a further embodiment it is proposed that the element is of a sandwich-like structure comprising at least two layers.

According to again a further embodiment it is proposed that the fabric is consisting of a thermo-plastic polymer material.

Again, according to a further embodiment at least one layer consisting of a hydrophobic and bio inactive material with a smooth outer surface, which is skin compatible.

Furthermore, it is proposed that at least one layer containing acoustically high absorption properties.

Further embodiments are described within further dependent claims or with reference to the attached drawings.

Further proposed is a method for producing an at least partially acoustically sealing element for retaining an in-the-ear device within an ear canal. In principal all kind of methods are feasible proposing the possibility of manufacturing a woven, non-woven, knitted or fibrous-web structure.

The present invention proposes the approach of using textiles made out of thermoplastic fiber materials as an acoustic seal that is shaped to its final form by a thermoforming process. The seal consisting of one or more layers, of which at least one layer is a woven, non-woven or knitted fabric, is thermoformed to its final form to be used as a sealing element for a hearing instrument in the ear canal.

Because of ergonomic reasons seals and earpieces have typically the shape of a dome as shown in FIG. 3. The shaping of a textile to a dome like shape can be done in several ways depending on the material and the fabrication technique of the textile. The technique proposed by the present invention report suggests the application of the thermoforming process. As a prerequisite for the thermoforming process the textile has to have thermoplastic properties in order to bring the textile in a permanent shape. In the thermoforming process the textile gets heated to a temperature between the glass transition temperature (Tg) and the melting point (Tm) of its filaments. At this temperature the textile gets pliable and can be formed to its final shape. Once the textile has taken its final shape the temperature gets reduced below Tg whereby the given shape of the textile gets frozen. The shape induced by the thermoforming process is regarded as permanent as long as the textile does not get exposed to a temperature close or above Tg during its usage. The thermoforming process is a fast and highly reproducible process thus especially suited for high volume production. Furthermore the invention proposes to manufacture the fabric or fibrous webs for the seal by using the combination of electrospinning together with thermoforming as described above.

In case of the sheet comprising two or more layers consisting of a woven, non-woven or knitted fabric or textile material made out of different polymer materials the sheet is formed into a permanent shape according to the shape of the seal using a thermoforming process of the fabric heated to a temperature between the glass transition temperature TG and the melting point TM of that polymer having the lowest melting point, and once the fabric has taken its final shape, the temperature gets reduced below the TG of such polymer, having the lowest TG, whereby the given shape of the textile gets frozen into the shape of the seal.

One basic idea of the proposed method is to fabricate the seals first e.g. by the approach of electrospinning. Electrospinning is a well-known and established technology allowing the fabrication of fleeces with tailored chemical and physical properties. Its fundamental idea are patented in 1934 by Formulas.[1] Since the 1980s and especially in recent years, the electrospinning process gained high attraction due to a surging interest in nanotechnology, as ultrafine fibers or fibrous structures of various polymers with diameters down to submicrons or nanometers can be easily fabricated with this process.[2]

Electrospinning shall be described in more details later on in relation to the attached figures.

With reference to the attached figures, examples of possible processes are described for the better understanding of the present invention. Within the attached drawings.

Figure 4:
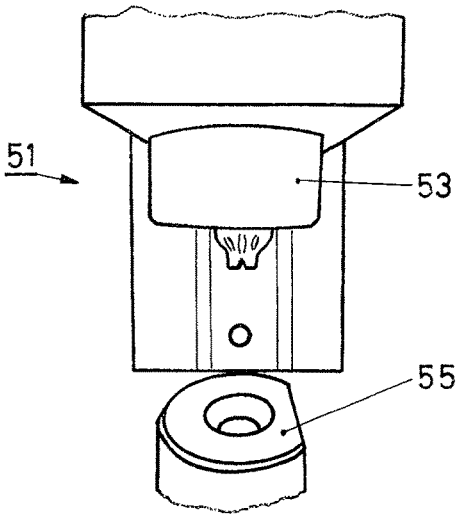
FIG. 4 shows a perspective view on a laboratory equipment for executing the thermoforming process.
Figure 5A:
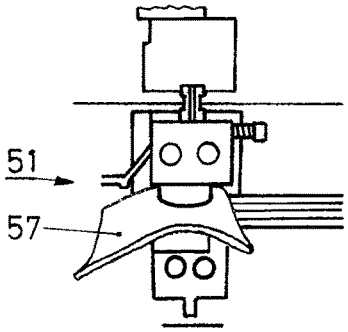
Figure 6:
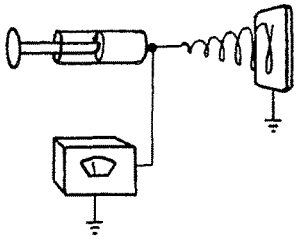
Figure 7:
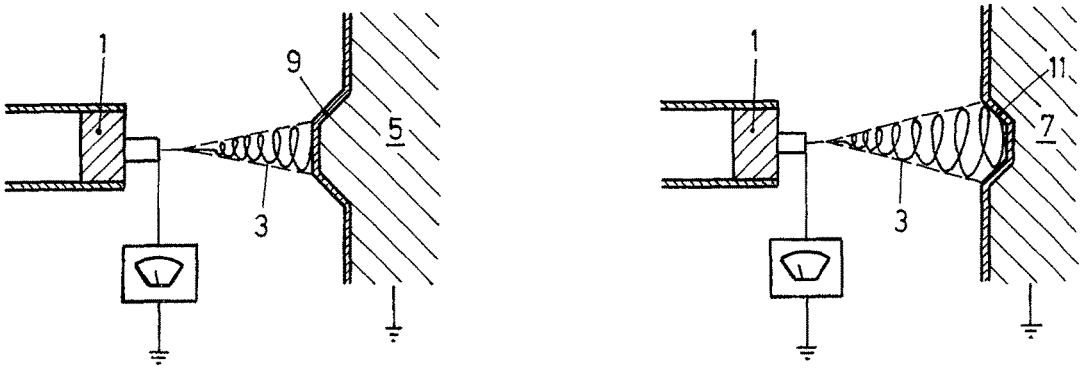
Figure 8:
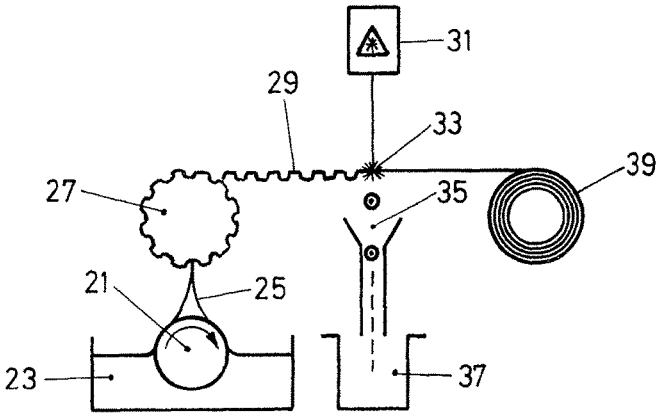
Figure 9:
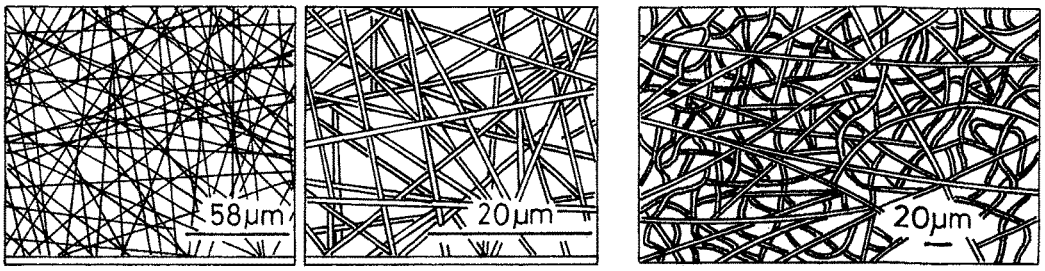
Figure 10:
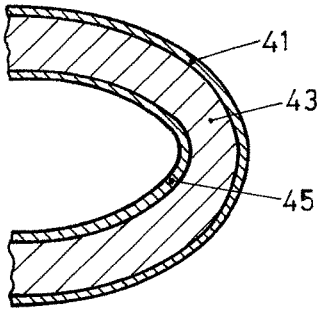

FIG. 5*a*+*b* show the thermoforming process using a laboratory equipment according to FIG. 4;

FIG. 6 shows a schematic description of electrospinning (taken from [3]);

FIG. 7 shows schematically a lab process to produce seals by electrospinning;

FIG. 8 shows a possible implementation of a high volume in-line manufacturing process of seals;

FIG. 9 shows example of fiber structures manufactured by electrospinning, and FIG. 10 shows a schematic view of an ear piece according to the present invention manufactured by thermoforming.

Figure 1:
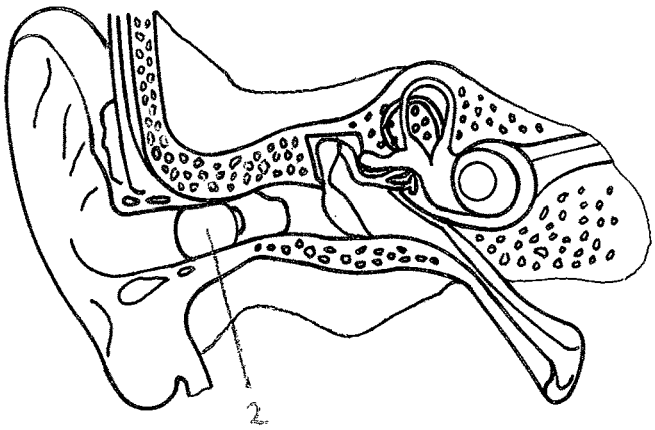
FIG. 1 shows in general a schematic view of an extended wear hearing instrument placed deep in the ear canal.
Figure 2:
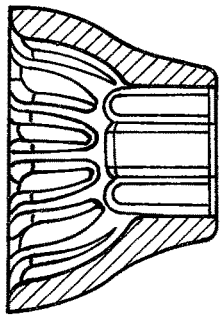
FIG. 2 shows a cross-section of a typical steel for extended wear applications molded according to known methods in the art.

Detailed explanations regarding FIGS. 1 and 2 have already been given within the description above.

Figure 3:
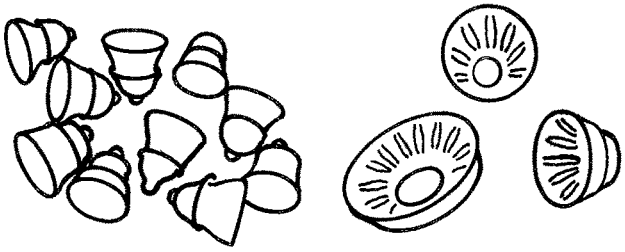
FIG. 3 shows silicon earpieces and polyurethane seals as known in the art.

FIG. 3 shows silicon earpieces on the left side and polyurethane seals used for extended wear application on the right side. Both types have a dome-like shape.

FIG. 4 shows a laboratory equipment 51 with mounted positive 53 and negative 55 heated molds for the execution of the thermoforming process for the production of seals according to the present invention.

Figure 5B:
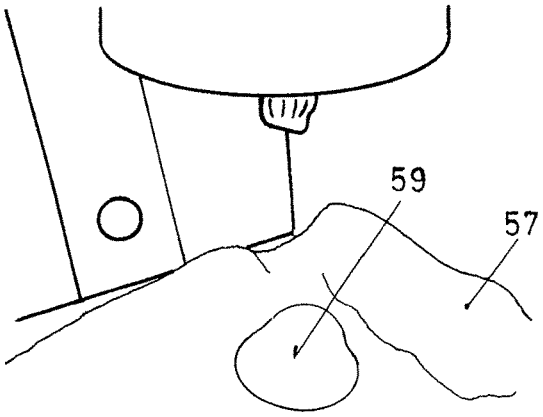

In practice, the thermoforming process would be done in one step. An e.g. textile tape consisting of one or more layers, of which at least one is a woven, non-woven or knitted fabric is conveyed to the forming tool 51 as shown in FIG. 5*a*, where the textile gets thermoformed. In FIG. 5*b* the e.g. sandwiched multilayer fabric 57 is shown after the thermoforming process, where the dome-like shaped section 59 is achieved.

After the forming process the tape is further conveyed to a singulation station (not shown), where the individual seals or earpieces get mechanically punched out of the tape 57. The production frequency would be within some 10 sec. providing a highly efficient production process.

E.g. in a preliminary investigation a non-woven polypropylene fabrics has been thermoformed by clamping the fabrics at a temperature of 230° C. between the core and the cavity taken from the reaction molding process of the Lyric seals. Temperature and clamping force has been controlled by the experimental equipment shown in Figure. The process parameters determining the result of the thermoforming process are temperature, time above Tg, and clamping pressure.

In case of a multilayer tape consisting of more than one fabric layer made out of a thermoplastic polymer the thermoforming process has to be executed below the melting point of the polymer, with the lowest melting point.

The main advantages of thermoforming textiles for the manufacturing of earpieces and acoustic seals are listed in the following table.

TABLE 3

Advantages by using thermoformed textiles for acoustic seals and earpieces.

| | |
|---|---|
| Material properties | The relevant material properties for seals and earpieces are mechanical compliance, acoustic attenuation and moisture permeability. These properties can be controlled by the selection of an adequate fiber material and by the texturing of the textile. Known properties of individual textile materials can be combined in on single material by calendaring. |
| Multilayer textile materials | Textiles differing in their physical or chemical properties can be brought together into one single material by calendaring processes. By this a sandwich-like structure can be achieved whereas the material properties can be varied along its cross-section. As example it would be feasible to have a sandwich-like structure with a thin smooth non-porous outer layer hindering cell adhesion and providing good conformability to the ear canal skin and a highly porous inner layer allowing for a high moisture and gas permeability and providing good adherence to the module in the case where the acoustic seals are adhesion bonded to the electronic module of the hearing aid. |
| Material Properties and selection of the base material | Ideally a standard textile material with known properties can be taken off-the-shelf as a base material which can either be directly thermoformed or modified in a refining process prior thermoforming. If textiles which are commercially available do not meet the requirements, a proprietary textile material can be customized by choosing the fiber material and the fabric technique. For example the manufacturing of such a textile material with a set of well-designed material properties could be realized by using the technique of electro-spinning. |
| Economics | The technology of textile processing is highly standardized and trimmed to high volume production. As a consequence textile processes are fast, reliable and cost efficient. |

The production of the woven, non-woven or knitted fabric can be executed as known in the art and therefore the present invention refers to any kind of woven, non-woven or knitted fabrics.

According to one special aspect of the present invention it is proposed that a non-woven textile realized by electrospinning is used for the thermoforming process for the manufacturing of seals.

Electrospinning as depicted in FIG. 6 as attached uses a high electric field applied between a tip of a die and an electrode. A droplet of a fluid (melt or solution) is feed to the tip of a die where it gets deformed by the electric field until it ejects building a charged jet from the tip toward the counter electrode where the fleece evolves. The advantages of electrospinning compared to more conventional spinning technologies are the feasibility to lace together a variety of types of polymers and fibers to produce layers of tailored structure and properties. Depending on the process parameters and specific polymer being used, a range of properties such as porosity, strength, weight moisture and gas permeability can be achieved in a controlled manner. The possibility of large scale productions combined with the simplicity of the process makes this technique very attractive for many different applications in biomedicine (e.g. tissue engineering, wound dressing, drug release, and enzyme immobilization), protective material, sensors, filtration and reinforced nano-composites [4]. The applications of electrospinning have been reviewed in a number of publications[2,5].

In Gibson et al. [6] the applications of electrospun layers directly onto 3D-screen forms obtained by 3D-scan are described.

The following describes the application of the process to the use case of manufacturing seals for extended wear.

In the present invention electrospun fibers of a polymer solution get accelerated in an electric field of several kV and get directed towards the inner side of a rotating mandrel functioning as both, an electrode and the net-shape of the final seal. A schematic of the process is depicted in FIG. 5. The thickness of the seal, the mechanical compliance, the acoustic attenuation, the moisture and gas permeability can be adjusted and controlled by the selection of the polymer and by controlling the process parameters. This technique would have several significant advantages as it allows the properties of the fabric to be tailored in a way that is not feasible with the technique used today.

One example: today the polyurethane foam seals have to be coated with a silicone coating (see also U.S. Ser. No. 07/664,282 and U.S. Ser. No. 07/580,537) in order to increase surface friction. Such a coating is no longer necessary in the proposed design and manufacturing method, as the coating can be either applied as an integral part of the coating process (=one first layer of material) or even completely omitted since the surface properties (density, porosity, roughness) can be controlled during the deposition process for the outer layer.

Another example concerns the porosity: from a physiological point of view it would be advantageous to have a smooth non-porous outer layer hindering cell adhesion and providing acoustic attenuation and a highly porous inner layer allowing for a high moisture and gas permeability. Electrospinning offers the unique property to control the porosity of the evolving fleece by varying the process parameters (e.g. voltage, distance between the electrodes or flow rate) and thus is able to produce a gradually changing porosity in a single fleece [5].

Also coming to the manufacturing of the seals, electrospinning is advantageous as the process parameters are easily accessible and can be controlled within a narrow specification resulting in a lower process variability and higher yield. The process parameters include (a) the solution properties, such as viscosity, elasticity, conductivity and surface tension, (b) governing variables, such as hydrostatic pressure in the capillary tube, electric potential at the capillary tip and the gap (distance between the tip and the collecting screen) and (c) ambient parameters, such as solution temperature, humidity and air velocity in the electrospinning chamber [2].

Electrospinning can be done in a simple laboratory scale as shown in FIG. 7 or in a fully automatic in line process as depicted in FIG. 8. Within FIG. 7 schematically the lab process to produce seals by electrospinning is shown, where on the left the polymer- or polymer solution jet respectively is dispensed from an electrode spray gun 1 and guided and accelerated through an electric field 3. On the left of FIG. 7, the polymer jet is directed to a positive mold 5 and on the right to a negative mold 7. By using the laboratory scale set-up as shown in FIG. 7, the polymer solution is deposited on the positive or negative mold, from which it can be separated afterwards. The dimensioning of the pin 9 on the left side or the cavity 11 on the right side is done according to known method for conventionally produced foamed sealing elements as known in the state of the art.

In a more industrialized in line process, as shown in FIG. 8, a drum 21 rotates in a polymer solution 23 and an electric field 25 between the drum and a slowly rotating cylinder 27 leads to the formation of a linear jet stream of polymer filling the cavities on the surface of the cylinder 27. By coating the rotating cylinder 27 continuously, a fleece 29 evolves tangentially to the slowly rotating cylinder which can be directed to a collecting spindle 39. On the course between the origin of the fleece and the spindle winding the fleece the seals get singularized by the use of a laser 31 or punch tool. Finally, the seal cut at 33, drop through a funnel 35 into a basket 37, where they can be taken for subsequent processing and testing.

The main advantages of electrospinning for the manufacturing of hearing instrument ear pieces compared to the method used today, are listed in the following table 4:

TABLE 4

Advantages of electrospinning for the manufacturing of earpieces

| | |
|---|---|
| Materialization | A large number of polymers are qualified to be used for Electrospinning<br>Huang et. al reported in 2003 that nearly one hundred different polymers, mostly dissolved in solvents have been successfully spun by electrospinning.[2]<br>A comprehensive data base of polymers suitable for electrospinning is presented in [2]. It is also feasible to use blends of polymer solutions to combine favorable properties from a number of different polymers in one fiber.<br>Candidates suggested as a base material for seals: PCL, PUR, PLA, PVA, Silk-like polymer, Silk/PEO blend, CA, PLGA, Collagen, Polyether block amide (PEBA). |
| Mechanical design and acoustic sealing | No restrictions regarding minimal local wall thickness, holes and steps. Feature sizes down to the micrometer can be achieved by a proper process control.[5]<br>Mechanical compliance and acoustic sealing can be tailored by the materialization, the diameter of the fiber, the alignment of the fibers and the material density. |

TABLE 4-continued

| Advantages of electrospinning for the manufacturing of earpieces | |
|---|---|
| Porosity | Porosity can easily be controlled by the process parameters. It would be feasible to have a sandwich-like structure with a smooth non-porous outer layer hindering cell adhesion and providing good acoustic attenuation and a highly porous inner layer allowing for a high moisture and gas permeability.[2] |
| Economics | Electrospinning is a well-established production method allowing large scale production with narrow process variability resulting in low yield losses.[2] |

In FIG. 9 examples of fibrous structures are shown. As shown in the three examples membranes and sheets, realized e.g. by electrospinning, are stochastic depositions of fibrous structures in the micrometer and nanometer scale.

Furthermore, one significant feature that can be easily realized with e.g. the described electrospinning approach, is a controlled combination of different materials and porosities.

By calendering the properties of individually manufactured textiles can be amalgamated in one single sheet of textile. By this a sandwich-like structure can be achieved where the material properties can be varied along its cross-section. As example it would be feasible to have a sandwich-like structure with a smooth non-porous outer layer hindering cell adhesion and providing good acoustic attenuation and a highly porous inner layer allowing for a high moisture and gas permeability. A schematic drawing of such a sandwich-like structure is shown in FIG. 10.

The figure shows an earpiece made by electrospinning and thermoforming that consists of three different layers. Those layers can be different in density/porosity, thickness and material combination for different functional features as described in table 3. The schematic view of an ear piece manufactured by electrospinning and thermoforming as shown in FIG. 10 shows a three-layer design. The outer layer 41 consists e.g. of a hydrophobic and bio compatible material, with a smooth surface with low porosity, which is skin compatible. The core layer 43 should be compressible and include a so called pillow-effect. In other words, the in between or core layer 43 could be made out of a thermoformed fabric or a foam, such as e.g. a polyurethane foam. The inner layer 45 should have an acoustically high absorption, which means, should include acoustic damping properties. For the production of the woven, non-woven, knitted or fleece-like fabric to be used in connection with the sealing elements, any method known in the art is possible in combination with the thermoforming process as proposed according to the present invention.

The great advantage of the seals as proposed within the present invention is that they comprise at least one layer which is a woven, non-woven, knitted or fibrous-web as proposed in one of the claims.

Compared to the state of the art where different layers of material with different properties are either combined by laminating layers together as described in U.S. Pat. No. 6,310,961 or by applying a coating e.g. by dipping an earpiece into a polymer solution as described in U.S. Ser. No. 07/580,537 the present invention offers a far more flexible approach in combining materials and structures during the manufacturing of an earpiece.

The great advantage of an ear piece or acoustic sealing retainer as proposed according to the present invention allow unique features for optimal wearing comfort and patient safety for future ear pieces due to the tailored material properties. Furthermore, the manufacturing costs are lower because of low process variability, higher yield better process control and more in line manufacturability.

The proposed material and processing method can also be used for other hearing instrument components, such as non-custom ear pieces for high power fittings.

BIBLIOGRAPHY

[1] Formhals, 1934. s.l. Patentnr. U.S. Pat. No. 1,975,504

[2] Huanga, Z.-M., 2003. A review on polymer nanofibers by electrospinning and. Composites Science and Technology, p. 2223-2253.

[3] Fortunato, 2012. Polymerverarbeitung. MedTech Day, EMPA, 2012

[4] Agarwal, S., 49 (2008). Use of electrospinning technique for biomedical applications. Polymer, p. 603-5621.

[5] Anon., 2007. Mini-review Some fascinating phenomena in electrospinning processes and applications of electrospun nanofibers. Polymer International, p. 1330-1339.

[6] Gibson, 2001. Transport properties of porous membranes based on electrospun nanofibers. A: Physicochemical and Engineering Aspects, p. 469-481.

[7] Zhu., 2006. Funct Mater, p. 568.

[8] www.elmarco.com

The invention claimed is:

1. An acoustic sealing element for use with an in-the-ear hearing device, comprising:

a thermoformed textile layer defining a three-dimensional dome-like shape and an opening configured to receive the in-the-ear hearing device.

2. An acoustic sealing element as claimed in claim 1, wherein the thermoformed textile layer comprises a thermoformed thermoplastic fiber textile layer.

3. An acoustic sealing element as claimed in claim 1, wherein the thermoformed textile layer has relatively high moisture and gas permeability.

4. An acoustic sealing element as claimed in claim 1, wherein the thermoformed textile layer comprises a hydrophobic and bio-inert layer with a smooth outer surface.

5. An acoustic sealing element as claimed in claim 1, wherein the thermoformed textile layer comprises a plurality of thermoformed textile layers.

6. An acoustic sealing element as claimed in claim 5, wherein the plurality of thermoformed textile layers include a hydrophobic and bio-inert layer with a smooth outer surface, a compressible core layer, and an acoustic damping inner layer.

7. An acoustic sealing element as claimed in claim 1, wherein the textile comprises an electrospun thermoplastic fiber textile.

8. A method comprising the step of:

thermoforming a fiber textile sheet into an acoustic sealing element having a three-dimensional dome-like shape and configured to retain a hearing device in an ear canal.

9. A method as claimed in claim 8, wherein the fiber textile sheet comprises a thermoplastic fiber textile sheet.

10. A method as claimed in claim 8, wherein the fiber textile sheet is selected from the group consisting of a woven fabric, a non-woven fabric, and a knitted fabric.

11. A method as claimed in claim 10, wherein the fiber textile sheet comprises a thermoplastic fiber textile sheet.

12. A method as claimed in claim 8, wherein the fiber textile sheet comprises a polymer fiber textile sheet;

the polymer has a glass transition temperature and a melting point; and thermoforming comprises heating the polymer fiber textile sheet to a temperature between the glass transition temperature and the melting point and, once the polymer fiber textile sheet has taken its final shape, reducing the temperature of the polymer fiber textile sheet to a temperature below the glass transition temperature.

13. A method as claimed in claim 8, wherein the fiber textile sheet comprises at least first and second polymer fiber textile layers;

the polymer in the first polymer fiber textile layer has a first glass transition temperature and a first melting point, the polymer in the second polymer fiber textile layer has a second glass transition temperature and a second melting point, one of the first and second melting points comprises a lower melting point, and one of the first and second glass transition temperatures comprises a lower glass transition temperature; and thermoforming comprises heating the polymer fiber textile sheet to a temperature between the glass transition temperature and the melting point of the polymer that has the lower melting point and, once the polymer fiber textile sheet has taken its final shape, reducing the temperature of the polymer fiber textile sheet to a temperature below the glass transition temperature of the polymer that has the lower glass transition temperature.

14. A method as claimed in claim 8, wherein the fiber textile sheet comprises an electrospun fiber textile sheet.

15. A method as claimed in claim 8, wherein the fiber textile sheet comprises a polymer fiber textile sheet; and the polymer includes one or more polymers selected from the group consisting of polycaprolacton, polyeruthane, polylacticacid, polyvinilacetat, silk-like polymer, silk/polyethilineoxide blend, celluloseacetat, polylactic-co-glucol-acid, polyether block amide, and collagen.

16. A method as claimed in claim 8, further comprising:

electrospinning at least one layer fiber textile sheet onto a mold prior to the thermoforming step.

17. A method as claimed in claim 8, further comprising:

the fiber textile sheet comprises a plurality of fiber textile layers that have been calendared together.

18. A method as claimed in claim 8, wherein the hearing device is selected from the group consisting of an extended wear in-the-ear hearing device and an earpiece.

* * * * *